US005967345A

United States Patent [19]

Subotin

[11] Patent Number: 5,967,345

[45] Date of Patent: Oct. 19, 1999

[54] BABY BOTTLE AND ACCESSORIES HOLDER

[76] Inventor: Jennifer Subotin, 2334 Silver Breeze Ct., San Jose, Calif. 95138

[21] Appl. No.: 08/852,236

[22] Filed: May 6, 1997

[51] Int. Cl.[6] ..... A47D 15/00; A47C 7/62

[52] U.S. Cl. ..... 211/119.007; 297/188.18; 248/103; 248/311.2

[58] Field of Search ..... 248/102, 309.1, 248/311.2, 314, 315, 205.2, 103, 104, 105, 106, 107, 364, 694; 224/148.4, 148.5, 148.6, 675, 231, 223, 572; 297/188.18; 383/37, 33, 22, 24; 211/119.007, 74, 86.01, 88.01

[56] References Cited

U.S. PATENT DOCUMENTS

| | | | |
|---|---|---|---|
| D. 332,176 | 1/1993 | Mueller | 224/223 X |
| D. 350,866 | 9/1994 | Miller et al. | D6/501 |
| D. 392,613 | 3/1998 | Peters | D12/416 |
| 784,914 | 3/1905 | Boyle | 248/102 X |
| 834,979 | 11/1906 | Herman | 211/74 |
| 1,525,928 | 2/1925 | Fitch | 211/119.007 X |
| 1,725,508 | 8/1929 | Bell-Clifford | 248/364 |
| 1,738,557 | 12/1929 | Beiling | 248/364 |
| 2,061,302 | 11/1936 | Egler | 297/188.18 |
| 2,485,461 | 10/1949 | Siegel | 248/102 |
| 2,592,087 | 4/1952 | Wallace | 224/231 X |
| 2,907,539 | 10/1959 | Vardan | 248/104 |
| 2,953,288 | 9/1960 | Peterson | 224/42.11 |
| 3,042,467 | 7/1962 | Germick | 297/188.18 |
| 3,991,961 | 11/1976 | Platzer, Jr. | 248/311.2 X |
| 4,062,510 | 12/1977 | Brochu | 248/102 |
| 4,121,797 | 10/1978 | MacNeil | 248/102 |
| 4,195,880 | 4/1980 | Henkhaus | 248/694 X |
| 4,220,302 | 9/1980 | Hampton et al. | 248/102 |
| 4,315,654 | 2/1982 | Crook | 297/188 |
| 4,339,061 | 7/1982 | Dunn | 224/407 |
| 4,416,438 | 11/1983 | King | 248/102 |
| 4,498,613 | 2/1985 | Donahue et al. | 224/251 |
| 4,535,921 | 8/1985 | Sanders | 248/311.2 X |
| 4,606,523 | 8/1986 | Statz et al. | 248/311.2 |
| 4,678,154 | 7/1987 | McFarland | 248/311.2 |
| 4,718,623 | 1/1988 | McClure | 248/102 |
| 4,726,551 | 2/1988 | Randall et al. | 248/102 |
| 4,728,147 | 3/1988 | Dutton | 297/188.18 |
| 4,819,846 | 4/1989 | Hannemann | 224/223 X |
| 4,865,239 | 9/1989 | Timbrook | 224/267 |
| 4,917,160 | 4/1990 | Hart et al. | 150/106 |
| 4,953,816 | 9/1990 | Wilkinson | 248/102 |
| 4,993,611 | 2/1991 | Longo | 224/148 |
| 5,040,711 | 8/1991 | Niederhauser et al. | 224/572 |
| 5,067,643 | 11/1991 | McKinney | 224/231 X |
| 5,201,448 | 4/1993 | Schue | 224/675 |
| 5,279,452 | 1/1994 | Huynh | 224/42.45 R |
| 5,325,991 | 7/1994 | Williams | 220/739 |
| 5,381,922 | 1/1995 | Gladman et al. | 220/481 |
| 5,433,361 | 7/1995 | O'Malley | 248/311.2 X |
| 5,624,090 | 4/1997 | Gammelgaard | 248/102 |
| 5,855,307 | 1/1999 | Biddick et al. | 224/148.6 X |
| 5,862,927 | 1/1999 | Tebeau | 248/104 X |

FOREIGN PATENT DOCUMENTS

| | | | |
|---|---|---|---|
| 2030121 | 5/1992 | Canada | 248/102 |

*Primary Examiner*—Ramon O. Ramirez
*Assistant Examiner*—Stephen S. Wentsler
*Attorney, Agent, or Firm*—David H. Jaffer

[57] ABSTRACT

A baby bottle and accessory holder having two cups, preferably constructed from fabric. The rims of the cups are supported adjacent to each other by a single length of rod stock bent in two circles, over which the cloth of each cup is positioned. An extension of the rod stock forms a support to assist in positioning the holder against a mounting surface. The extension works in cooperation with a strap, joined to the rod stock near the union of the two cups and the support, having a loop and hook material for securing the baby bottle and accessory holder to an object such as an arm of a chair, a car seat, a backpack, or a person's belt.

3 Claims, 6 Drawing Sheets

BABY BOTTLE AND ACCESSORIES HOLDER

BACKGROUND OF THE INVENTION

Field of the Invention

The present invention relates generally to baby bottle holders, and more particularly to a baby bottle holder having two containers with facility for retaining accessories, and for flexibly securing the holder to various furniture and other structures.

Brief Description of the Prior Art

Numerous attempts have been made in the past to meet the needs of a parent in dealing with the substantial paraphernalia associated with care of a baby. Baby bottles and related accessories are usually stuffed in bags, distinguishable only by the color and texture of material and ornamentation as revealing its purpose. In addition to the general utility bag, the need for special apparatus for handling the baby bottle has been recognized. For example, numerous patents have issued disclosing apparatus for meeting the need of securing and positioning the baby bottle.

U.S. Pat. No. 5,325,991 by Williams describes a bottle holder for general use, having a flexible hook attached for suspending the holder from an object such as a car window edge. U.S. Pat. No. 4,718,623 by McClure discloses a container for a baby bottle when in use by a baby. The container has a strap attached, which slides through a loop having hook and loop material for adhering the loop, and thereby the container and bottle to an object. The prior art has generally addressed the need for holding a baby bottle in place while the baby feeds. Other designs for this purpose are disclosed in U.S. Pat. No. 4,062,510 by Brocher and U.S. Pat. No. 4,220,302 by Hampton et al. Brocher's device suspends the bottle holder from crib bars, and the Hampton et al. device positions the bottle on a mother's chest. Each of these devices is for suspending only one bottle, and does not provide for retaining accessories, or for holding a baby bottle or accessories when not in use, i.e., when the baby is not feeding.

Since a baby must go nearly everywhere a parent goes, there is a need for compact and adaptable equipment. In particular, the baby bottle must be close at hand. With all the other equipment required, it is too much of a burden to purchase a large quantity of bottle holders, each designed for a particular situation, and then attempt to always have the correct one in the utility bag for use when needed. Without a proper container, the bottle usually ends up on any available surface, and often on the floor, raising a sanitation issue.

It is therefore apparent that a single, flexibly designed baby bottle and accessory holder would be very desirable, particularly one that could attach to the common articles of home furniture, as well as to one's person and to various other structures, such as those found in the family automobile.

SUMMARY OF THE INVENTION

It is therefore an object of the present invention to provide a baby bottle and accessory holder that can be mounted or suspended from a variety of surfaces and articles.

A further object of the present invention is to provide a baby bottle and accessory holder providing a clean environment for a baby bottle and accessories.

Another object of the present invention is to provide a baby bottle and accessory holder that is durable and reusable.

A still further object of the present invention is to provide a baby bottle and accessory holder that is safe to use and easy to clean.

Briefly, a preferred embodiment of the present invention includes a baby bottle and accessory holder having two cups, preferably constructed from fabric. The rims of the cups are supported adjacent to each other by a single length of rod stock bent in two circles, the cloth of each cup formed over one of the circles. A length of rod stock between the two circles is bent in a figure eight pattern forming a support to assist in positioning the holder against a mounting surface. The support works in cooperation with a strap that is joined to the rod stock near the union of the two cups and the support. The strap has loop and hook material, allowing its use in securing the baby bottle and accessory holder to an object such as the arm of a chair, a car seat, a backpack, or a person's belt. A length of fabric is stitched at periodic intervals around the exterior fabric surface of each cup for retaining accessories such as baby rattles.

An advantage of the present invention is the provision of an apparatus that can hold a baby bottle as well as accessories.

A further advantage of the present invention is that it can be mounted to a wide variety of objects.

A still further advantage of the present invention is that it is an aid in keeping a baby bottle and accessories in a clean an orderly manner.

Another advantage of the present invention is that the apparatus is durable and easy to clean.

IN THE DRAWING

Figure 11:
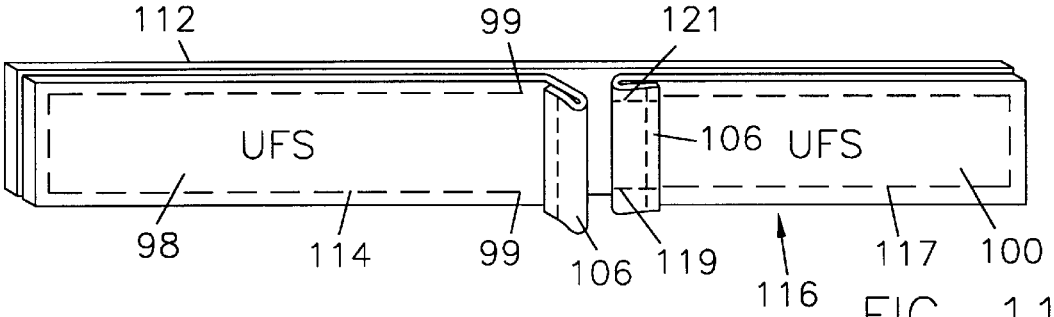

FIG. 11 shows stitching of fabric assemblies 98 and 100 onto the 3 by 13 inch strap.

Figure 12A:
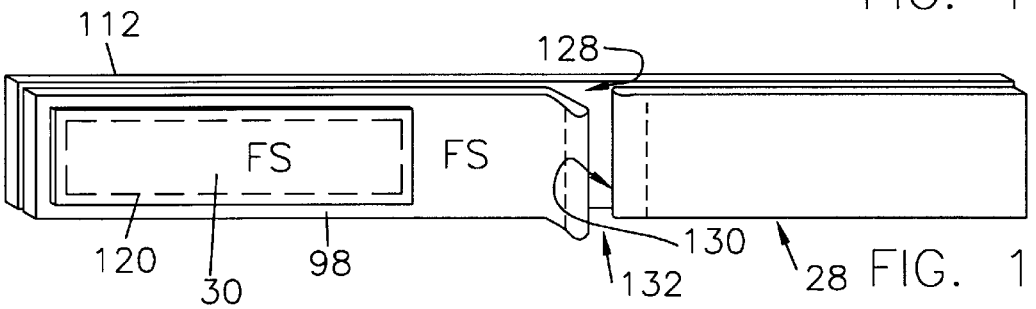
Figure 12B:
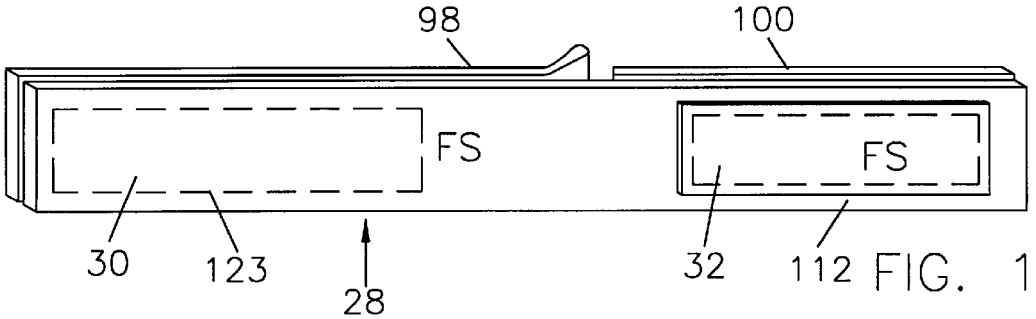
Figure 13:
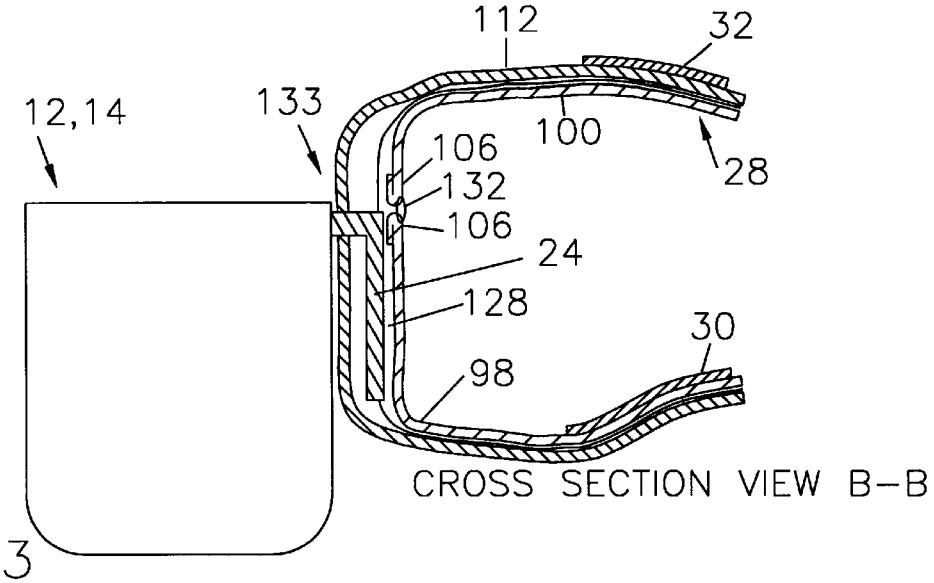
Figure 14:
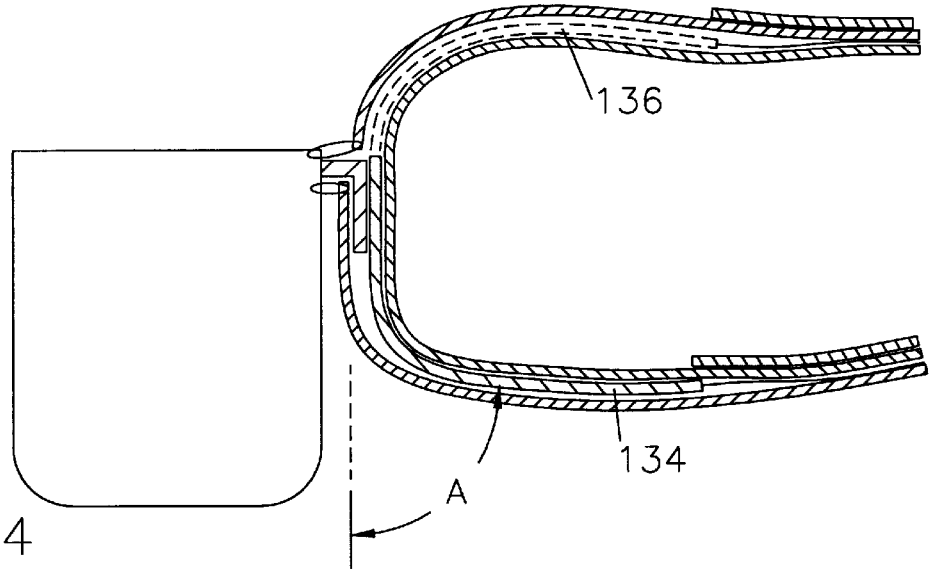
Figure 15:
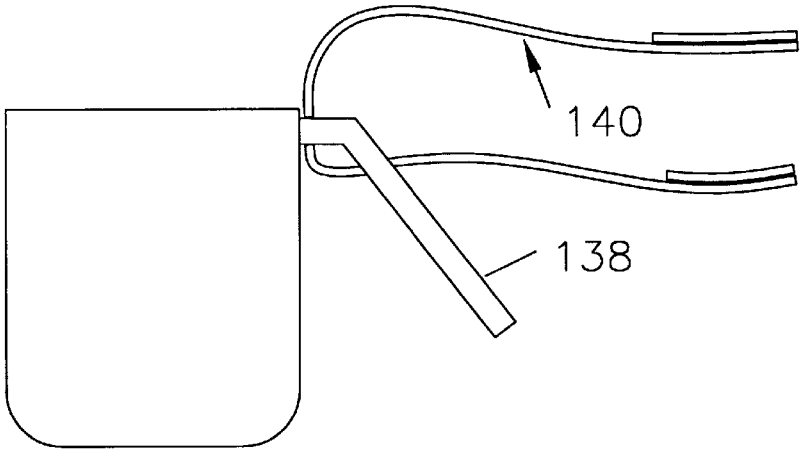
Figure 16:
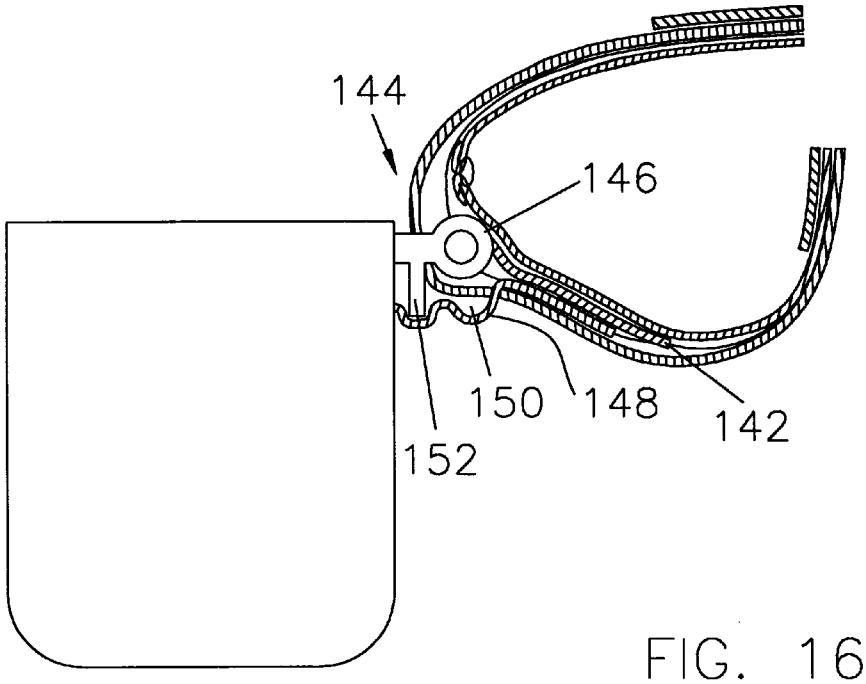

FIG. 12A shows the assembly of FIG. 11 turned inside-out;

FIG. 12B shows the back side of the assembly 28 shown in FIG. 12A, exposing hook and loop material 32 to view;

FIG. 13 shows the strap assembled to the frame;

FIG. 14 illustrates an alternate support structure;

FIG. 15 illustrates a support that is separate from the strap;

FIG. 16 shows the use of a hinged adjustable support.

Figure 17:
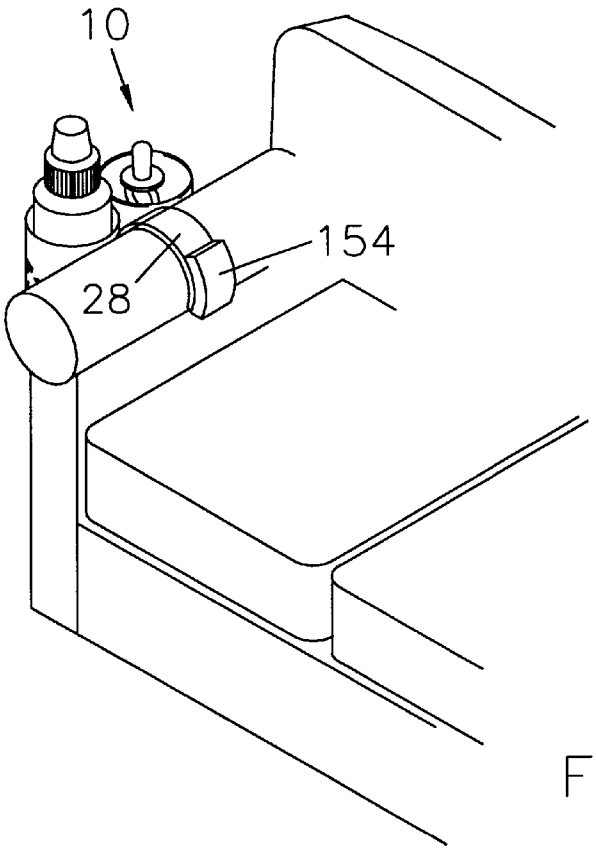

FIG. 17 shows a weight attached to the bottle holder strap.

DESCRIPTION OF THE PREFERRED EMBODIMENT

Figure 1:
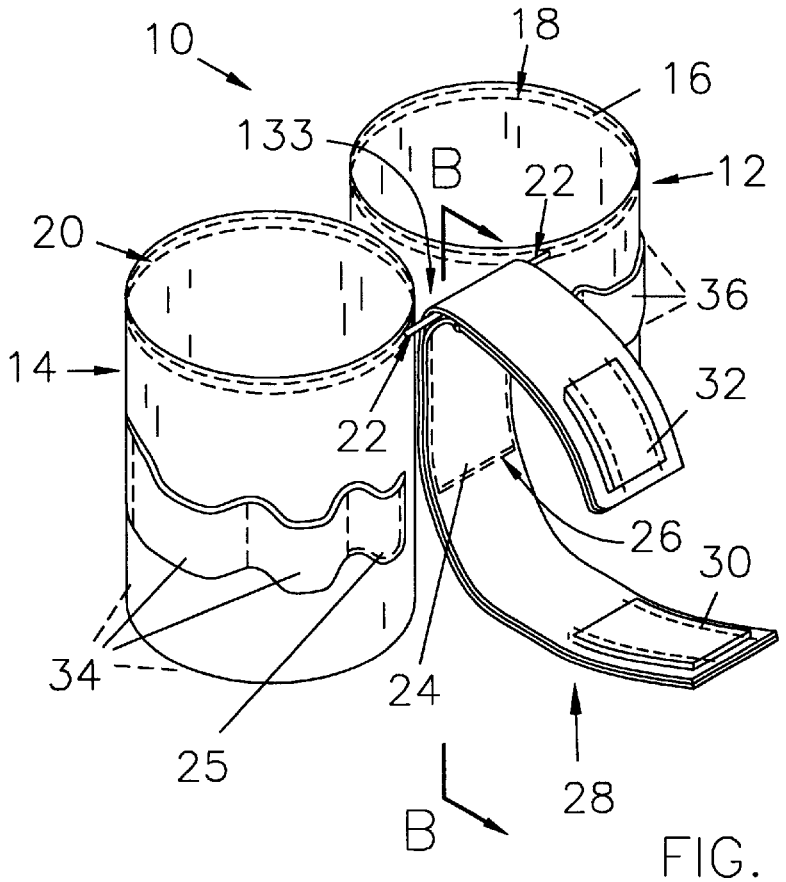
FIG. 1 shows a preferred embodiment of the invention.

Referring now to FIG. 1 of the drawing, a preferred embodiment 10 of the present invention is shown. Two cups 12, 14, preferably constructed of fabric are formed over a rod stock frame 16 bent into two circular portions 18, 20 covered by the fabric as indicated by the dashed lines. The circular portions 18, 20 are joined by portion 22. A support 24 is indicated by the dashed lines 26 extending from, or as an integral part of the frame 16 positioned between and adjoining the two cups 12 and 14. The support 24 can take on many forms and can be either fixed in position or adjustable, as will be fully described in the following description as related to the various figures of the drawing.

In the embodiment of FIG. 1, the support 24 is enclosed in a strap 28, preferably made of fabric and having hook and loop pads 30, 32 for adjustably fitting the strap around an object, such as an arm of a chair. In use, one or both cups 12, 14 can be used to hold a baby bottle, or one cup can hold accessories. Loops and/or pockets 34, 36 are shown sewed to the sides of the cups 12, 14 and provide additional storage of accessories, such as baby rattles, etc.

The loops or pockets 34 are shown generally as loops, but can also be pockets when stitched at the bottom, such as at 25. The loops/pockets can extend partially or totally around the cups, and can be of any size, as required to retain a particular object. These alternative embodiments are included in the spirit of the present invention.

The constructional details described in reference to FIG. 1 and in the following descriptions are given by way of example. Other ways of constructing the apparatus will be apparent to those skilled in the art, and these are included in the spirit of the present invention. The device as shown in FIG. 1 illustrates a novel apparatus for holding a baby bottle and accessories, including two cups, or more generally containers, constructed from any of a wide variety of materials. For example, the cups could be constructed as an integrated plastic molding. The support 24 may or may not be integrated with the strap 28, and may or may not be adjustable. It can also be in a fixed position other than perpendicular to the plane of the cup rims as shown. The strap assembly 28 can be constructed from any flexible material, and can be secured to an object either through use of hook and loop material 30, 32 as shown, or with other means, such as buckles or snaps.

Figure 2:
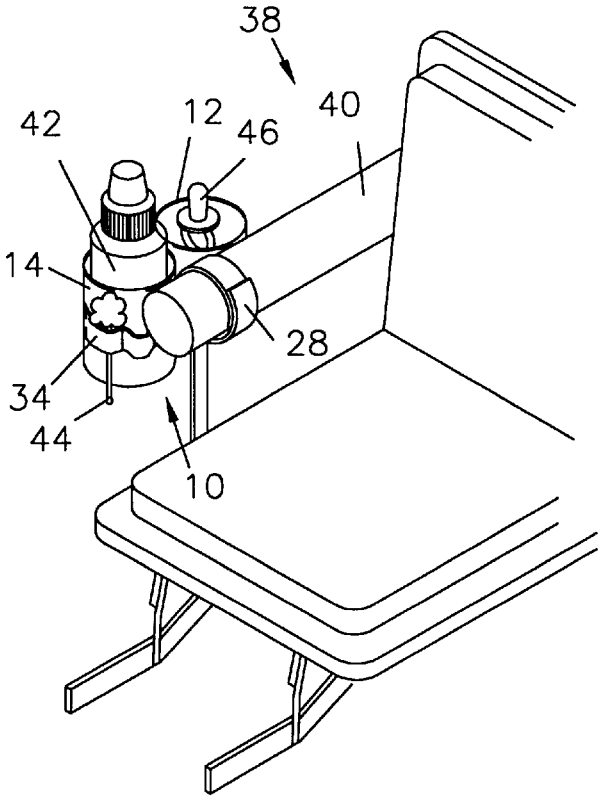
FIG. 2 illustrates the use of the present invention mounted on the arm of a chair.

FIG. 2 illustrates the use of the baby bottle and accessory holder 10 mounted to a chair 38 by encircling the arm 40 with the strap 28. A baby bottle 42 is being held in cup 14, a baby rattle 44 is secured by loop 34 and a pacifier 46 is shown placed in cup 12. The combination of support 24 (not shown) and strap 28 retains the holder 10 in place.

Figure 3:
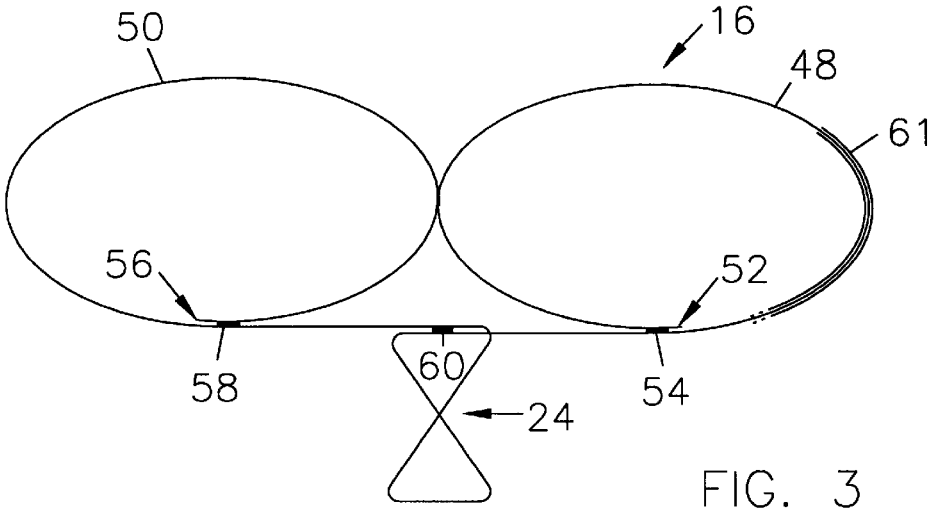
FIG. 3 shows construction of a frame for the baby bottle and accessories holder.

A preferred method of construction of the bent rod stock frame 16 of FIG. 1 is illustrated in FIG. 3, also showing a preferred method of constructing the support 24 as an integral part of the frame. The frame is preferably constructed from a 3/32 inch diameter mild steel rod approximately 34 inches in length. The 34 inch length of rod stock is bent into a 3½ inch outside diameter circle 48, corresponding to circular portion 18 in FIG. 1, and a circle 50 corresponding to circular portion 20 in FIG. 1. A first end 52 of the rod stock 16 is welded at 54 on the rod to secure the circle 48. Similarly, the opposite end 56 is welded at 58 to secure the circle 50. In between the two weld joints 54 and 58, the rod stock is bent in a figure eight pattern to form the support 24, which is approximately 1½ inches long and 1 inch wide. The preferred orientation of the support is perpendicular to the 3½ inch circular portions 48, 50. Excess wire is cut off once the frame 16 is completed. The figure eight pattern is stabilized by weld joint 60.

Although the preferred frame material is 3/22 inch mild steel rod, other materials and construction methods are also included in the spirit of the present invention. For example, stainless steel rod can also be used, or other materials known to those skilled in the art. Other construction methods, for example, include stamping a frame from sheet metal and bending a support into position, etc. When the frame material is a metal, it is desirable to apply a coating to the frame to prevent rust from forming. Examples of coating materials include urethane, plastic dip, or similar products. such a coating is partially shown by lines 61 in FIG. 3, and is applied to cover the entire frame 16.

Figure 4:
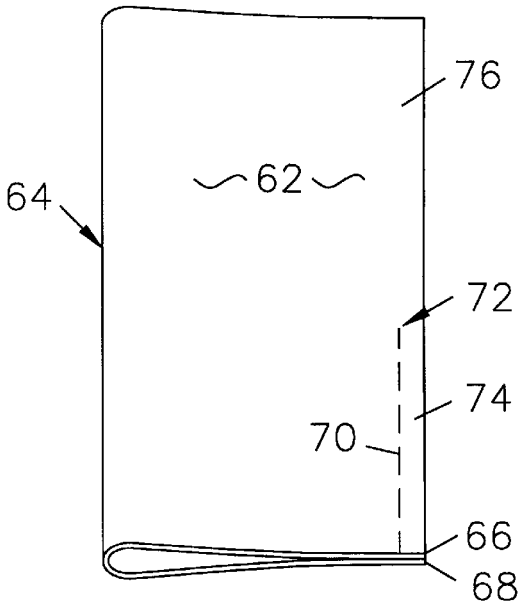
FIG. 4 shows a 10"×12" piece of fabric prepared to form the walls of a cup.
Figure 5:
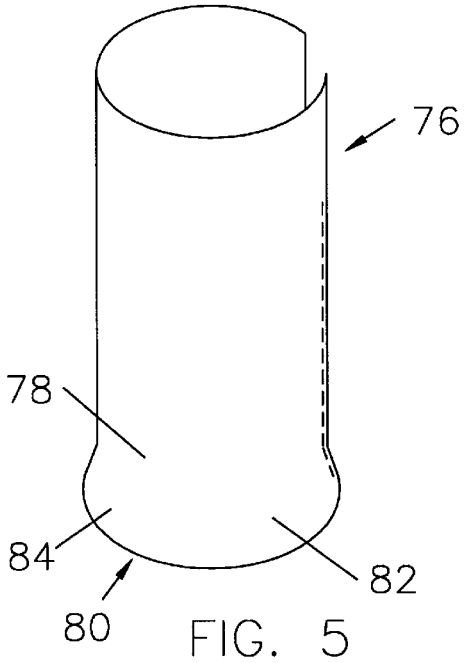
FIG. 5 shows the installation of a cup bottom.
Figure 6:
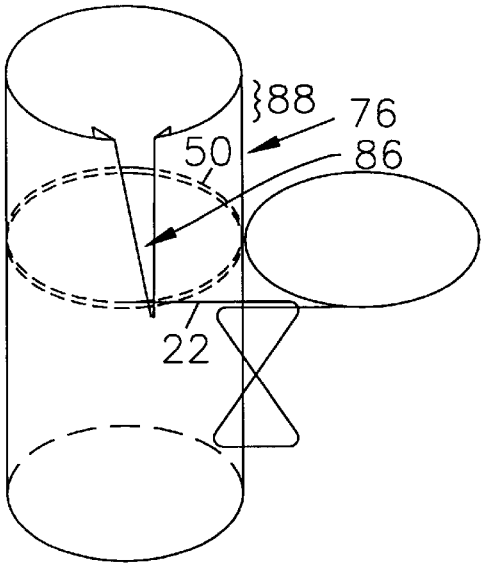
FIG. 6 shows the first step of assembly of the sleeve onto the frame.
Figure 7:
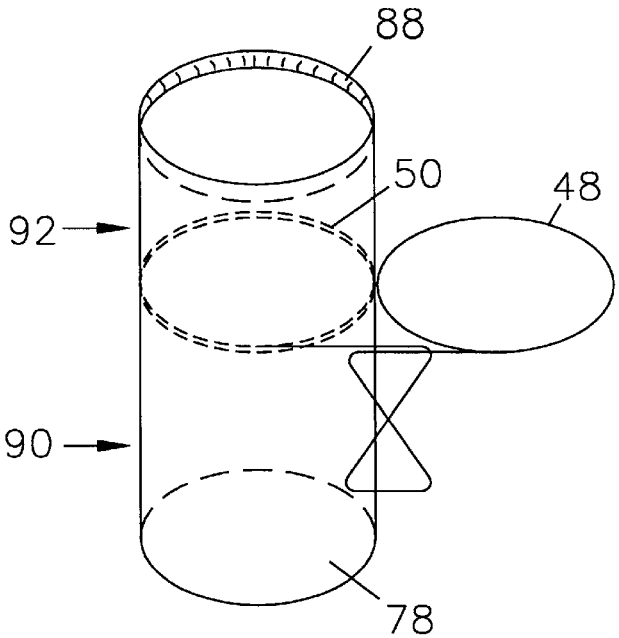
FIG. 7 shows the formation of a half-inch seam.
Figure 8:
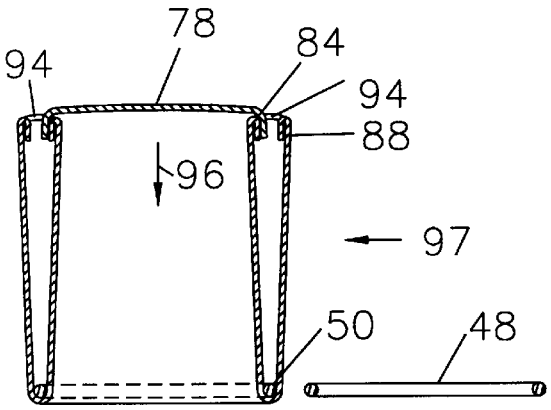
FIG. 8 shows assembly of the sleeve bottom half with the top half.
Figure 9:
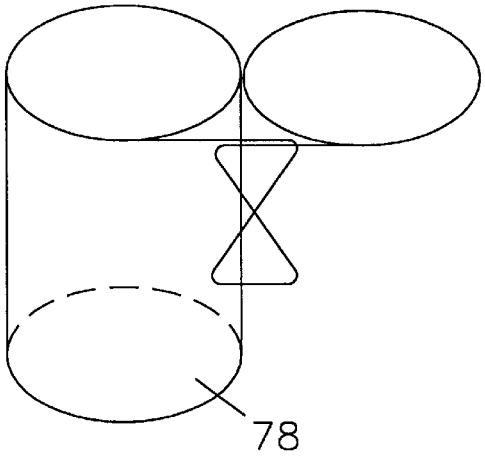
FIG. 9 shows the fabric assembly as shown in FIG. 8 turned inside out.

FIGS. 4–8 show a preferred construction of the cups 12, 14. A single cup is formed, as shown in FIG. 4 by first taking a 10 inch by 12 inch piece of fabric 62 and folding it in half along the 12 inch edge 64 to form the 6 inch by 10 inch shape shown. The two 12 inch edges 66, 68 are then stitched together along line 70, extending half way along the 12 inch dimension to point 72, with a one half inch seam 74, to form a sleeve 76. The sleeve 76 is opened as shown in FIG. 5, and a circular piece of fabric 78 is stitched to the bottom end 80 of the sleeve 76 at 82, with a one half inch seam 84. Following this, the sleeve 76 is turned inside out, putting the seams on the inside, and as shown in FIG. 6, circular portion 50 is inserted into the sleeve 76 with portion 22 extending out of the unstitched opening 86. The opening 86 is then stitched closed, and a top portion 88 forming a ½ inch seam is folded inward as shown in FIG. 7. The sleeve now has a bottom half 90 and a top half 92, divided by the level of the rim 50. The next step in the assembly is to push on the bottom portion 78, to put the bottom 90 inside the top half 92 as illustrated in the cross sectional view of FIG. 8, and stitch the portion 88 to the seam 84, illustrated by stitches 94. The bottom portion 78 is then pushed downward in the direction of arrow 96, to turn the cloth fabric assembly 97 of FIG. 8 inside out, into the position of FIG. 9. This procedure is repeated to construct the cup 12 over rim 48.

Figure 10A:
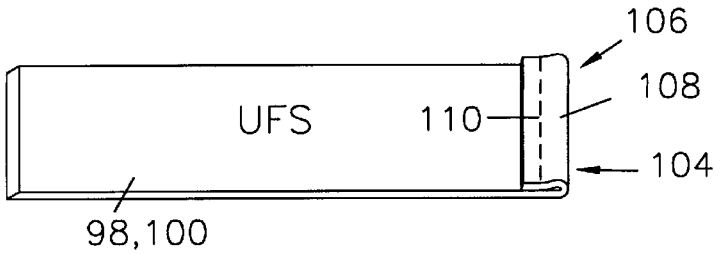
FIG. 10A shows construction of fabric assemblies 98 and 100.

The assembly of the strap 28 is illustrated in FIGS. 10–12. A strip of 3"×7.5" fabric 98, and a strip of 3"×6" fabric 100 are prepared by forming a finished edge 104 on one end 106 of each of the strips 98 and 100, as indicated in FIG. 10A. The material is folded over ¼ inch once, and stitched along the fold 108 at line 110.

If the material is of the type having a finished (right) side and an unfinished (wrong) side, these sides are indicated on the figures by "FS" for finished side and "UFS" for unfinished side.

Figure 10B:
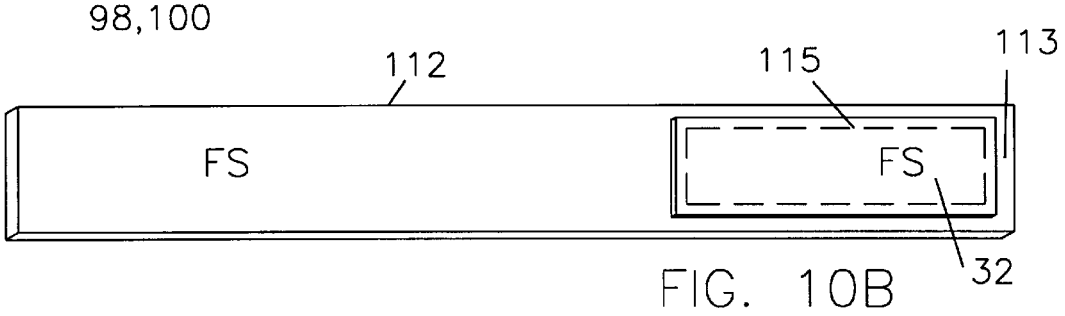
FIG. 10B shows preparation of a 3 by 13 inch strip in the formation of a strap.

A 3"×13" strip of material 112 is prepared by attaching a 4½"×2" piece of hook and loop material 32 with stitches 115, to the finished side of material 112, as shown in FIG. 10B. The material is positioned about ½ (113) from one end as indicated. The finished side (FS) of the hook and loop material 32 is the side with hooks/loops, and faces away from the material 112.

The strips 98 and 100 are then placed over the 3 inch by 13 inch full length fabric portion 112, as shown in FIG. 11, and stitched together. The stitches 114 securing strap 98 to strap 112, stop at points 99, leaving the finished end 106 of strap 98 loose. This is desirable, as will be more fully explained in the following text, for the purpose of facilitating stitching the end 106 of strap 100 to the end of strap 98 after assembly with the frame. Strap 100 is attached to strap 112 by stitches 117 that extend from point 119 to point 121 as shown. The stitching of pieces 98 and 100 to 112 leaves openings 128 and 130 at 132, through which the assembly 116 can be turned inside out. As indicated by the FS and UFS notation, the finished sides of straps 98, 100 and 112 are facing each other in FIG. 11. The assembly 116 of FIG. 11 is then turned inside out, resulting in the finished sides with the hook and loop material 32 facing outward as shown in FIG. 12B. A 2"×5" piece of hook and loop material 30 is then attached to the strip 98 by stitches 120 through both strips 98 and 112 as shown in FIG. 12A. This forms the completed strap assembly 28. FIG. 12B shows the assembly 28 turned over, exposing the hook and loop material 32 to view. The material 30 is now on the opposite side, as indicated by dashed lines 123.

The assembly of the baby bottle and accessory holder is then completed by inserting the support 24 into opening 128, into the cavity defined by the space between half length 98 and length 112. The final assembly of the strap is shown more clearly in cross-sectional view B—B of the strap 28 and support 24 as shown in FIG. 13. The strap 28 is inserted through the opening 133 (behind portion 22 and between the cups 12, 14; see FIG. 1), and the support 24 is inserted into opening 128. The ends 106 of the strips 98 and 100 are then secured together by stitches 132.

Alternate embodiments of support 24 are illustrated in FIGS. 14 and 15. FIG. 14 shows the use of a flexible, non-resilient metal support 134 that can be bent to any angle A. Another support embodiment is shown by the dashed outline 136, illustrating a support extending generally above the cups 12, 14 at any angle. Either of supports 134, 136 can be used alone, or in combination. The two supports 134, 136 would be useful, for example, in securing the holder to a flat thin chair arm, or other similarly shaped object. FIG. 15 illustrates a support 138 independent of a strap 140. The support, again, can be either fixed in position at any angle to the cups, or can be adjustable.

Various ways of making an adjustable support will be apparent to those skilled in the art from reading this disclosure, and these are included in the spirit of the present invention. For example, FIG. 16 shows another method of constructing an adjustable support. An arm 142 is connected to a cup or frame assembly 144 by hinge 146. A spring steel extension 148 with locking grooves 150 is attached to the arm 142 and locks the arm in position when a ridge 152 is engaged in one of the grooves 150.

Although the above description focuses on details of the preferred embodiment, including a steel wire frame, cloth fabric cup structure, and other specific construction details, the invention also includes those alternative construction methods that will be apparent to persons skilled in the art. For example, the cups could be molded plastic, and the support could be constructed from any material sufficiently durable and strong, and can be either adjustable or fixed in position. The strap can also be constructed from various flexible materials, such as plastic, nylon, etc., and any of the various forms of buckles, clasps, snaps, etc. can be used as alternates to hook and loop material to secure the strap around an object. For applications where it is not possible to extend the strap around an object, such as in FIG. 17, a weight 154 can be attached to the strap 28 by hook and loop material, or by any of various means that will be apparent to those skilled in the art for the purpose of retaining the holder 10 in place.

Although a preferred embodiment of the present invention has been described above, it will be appreciated that certain alterations and modifications thereof will become apparent to those skilled in the art. It is therefore intended that the appended claims be interpreted as covering all such alterations and modifications as fall within the true spirit and scope of the invention.

What is claimed is:

1. A baby bottle and accessories holder comprising:

(a) a first cup including (i) a first wire rim lying in a first plane and having a center with a first axis therethrough and normal to said first plane;

(ii) a first cloth container suspended from said first wire rim;

(b) a second cup including (i) a second wire rim lying in said first plane and having a center with a second axis therethrough and normal to said first plane;

(ii) a second cloth container suspended from said second wire rim;

(c) a connecting wire for connecting said first rim to said second rim;

(d) a strap attached to said connecting wire, said strap configured for extending in an arc defining a second plane orthogonal to said first plane; and (e) a support including a rigid member extending from said connecting wire for bearing against a surface, thereby retaining said first plane in a horizontal position.

2. A holder as recited in claim 1 wherein said support is constructed of rod stock.

3. A holder as recited in claim 1 wherein said support extends in a direction parallel to said first axis.

* * * * *